US005295352A

United States Patent [19]

Beebe et al.

[11] Patent Number: 5,295,352

[45] Date of Patent: Mar. 22, 1994

[54] DUAL FUEL INJECTOR WITH PREMIXING CAPABILITY FOR LOW EMISSIONS COMBUSTION

[75] Inventors: Kenneth W. Beebe, Galway, N.Y.; Victor R. Gardy, Shelburne, Vt.

[73] Assignee: General Electric Company, Schenectady, N.Y.

[21] Appl. No.: 924,507

[22] Filed: Aug. 4, 1992

[51] Int. Cl.[5] ..... F02C 7/26

[52] U.S. Cl. ..... 60/39.06; 60/737; 60/742; 239/404; 239/431; 239/434

[58] Field of Search ..... 60/737, 742, 39.06; 239/404, 429, 430, 431, 434

[56] References Cited

U.S. PATENT DOCUMENTS

| | | | |
|---|---|---|---|
| 2,993,338 | 7/1961 | Wilsted | 60/742 |
| 3,149,463 | 9/1964 | Withers et al. | 60/742 |
| 3,912,164 | 10/1975 | Lefebvre et al. | 239/5 |
| 4,587,809 | 5/1986 | Ohmori et al. | 60/737 |
| 4,701,124 | 10/1987 | Maghon et al. | 431/284 |
| 4,726,182 | 2/1988 | Barbier et al. | 60/39.23 |
| 4,850,194 | 7/1989 | Fuglistaller et al. | 60/737 |
| 4,974,415 | 12/1991 | Shekleton et al. | 60/733 |
| 4,982,570 | 1/1991 | Waslo et al. | 60/733 |

*Primary Examiner*—Richard A. Bertsch
*Assistant Examiner*—Michael I. Kocharov
*Attorney, Agent, or Firm*—Nixon & Vanderhye

[57] ABSTRACT

Dual fuel/air injectors are provided, including a conventional central diffusion flame fuel nozzle 12. A fuel injector 14 for pre-mixing fuel and air for low emissions combustion and coaxial to the central nozzle includes a plenum 30 about the central injector having an air inlet 32, an annular pre-mix chamber 34, a fuel injection region 36 between the pre-mix chamber and air inlet 32 and an outlet 40 defined in part by swirler vanes 38. Radially projecting fuel spokes 46 extend into the plenum 30 and are supplied fuel from a manifold 44. Apertures 52 in the spokes supply fuel in a circumferential direction to the incoming air. The spokes in the plenum define throat areas T which, in the aggregate, define a minimum cross-sectional area of the plenum 30. Differential air flows through the throats provide inverse differential fuel distribution in the throats whereby a uniform fuel/air mixture strength distribution occurs at the throats. The fuel/air pre-mix thus maintains uniform hot gas temperature distribution in the combustor reaction zone, minimizing the formation of pollutants in the exhaust.

19 Claims, 1 Drawing Sheet

DUAL FUEL INJECTOR WITH PREMIXING CAPABILITY FOR LOW EMISSIONS COMBUSTION

TECHNICAL FIELD

The present invention relates to a fuel injector for pre-mixing fuel and air for combustion in a gas turbine combustion system and particularly relates to a coaxial fuel injector designed to minimize exhaust gas emissions in lean pre-mixed fuel/air combustion systems.

BACKGROUND ART

Air-polluting emissions are an undesirable by-product of the operation of gas turbines. The primary air-polluting emissions produced by gas turbines burning conventional hydrocarbon fuels are oxides of nitrogen, carbon monoxide and unburned hydrocarbons. It is well known that oxidation of molecular nitrogen in air-breathing engines is dependent upon the maximum hot gas temperature in the combustion system reaction zone. The rate of chemical reactions forming oxides of nitrogen is an exponential function of temperature. Consequently, if the temperature of the hot combustion gas is controlled to a low level, thermal $NO_x$ will not be produced.

A typical and preferred method of controlling the temperature of the reaction zone of a gas turbine combustor below the level at which thermal $NO_x$ is formed includes pre-mixing the fuel and air to a lean mixture prior to combustion. The thermal mass of the excess air present in the reaction zone of a lean, pre-mixed combustor absorbs heat and reduces the temperature rise of the products of combustion to a level where $NO_x$ is not formed. However, by lowering the temperature in the reaction zone to that level, the fuel/air mixture strength is reduced to a level close to the lean flammability limit for most hydrocarbon fuels. As a consequence, lean, pre-mixed combustors tend to be less stable than more conventional diffusion flame combustors and do not provide adequate turn-down for operation over the entire load range of the gas turbine. Stability for operation over all load conditions required for gas turbine operations, with minimum emissions of air pollutants in the gas turbine exhaust can be achieved with proper pre-mixing capability.

Dual fuel injectors with pre-mixing capability for heavy duty industrial gas turbines are known. For example, in U.S. Pat. No. 4,701,124, pre-mixing capability is provided. However, that design is not afforded in a compact envelope, nor does it achieve uniform fuel/air mixture in a manner which tolerates maldistribution of inlet air flow/velocity while maintaining a uniform fuel/air mixture strength at the injector discharge, which is necessary to achieve low emissions combustion.

DISCLOSURE OF THE INVENTION

According to the present invention, there is provided a dual fuel injector comprised of a centrally located, high pressure, air-atomized liquid fuel nozzle for a diffusion flame combustor surrounded by a coaxial fuel injector, which pre-mixes fuel and air for low emissions combustion. The central nozzle includes a bore terminating at one end in an air swirler. Diffusion gas openings are provided at the base of the air swirl slots for receiving and injecting high pressure gas fuel into a mixing cup. The combined diffusion air and diffusion gas flow exits the swirler into the cup, the swirling flow inducing a recirculation zone along the center line of the cup which causes hot gas to be drawn back from the combustor reaction zone and anchors the flame front within the cup.

The coaxial fuel injector forming part of the present invention, which is used in conjunction with the above-described central and conventional nozzle, includes an annular plenum having an inlet, a pre-mixing chamber, a fuel inlet between the plenum air inlet and the pre-mixing chamber, and swirl blades at the outlet of the plenum. A plurality of fuel spokes or tubes extend into the plenum in a generally radial direction between the air inlet and pre-mixing chamber. Fuel flows from a manifold into the spokes or tubes. Adjacent spokes or tubes define throat areas in the plenum which, in the aggregate, define a minimum cross-sectional area through the plenum from its air inlet to its fuel/air mixture outlet at the swirler blades. Fuel outlet apertures are provided in the spokes or tubes and which apertures open on opposite sides of the tubes in the circumferentially extending plane normal to the flow through the plenum, i.e., normal to the axis of the annular plenum. For high efficiency mixing, the apertures of adjacent fuel tubes lie in circumferential opposition one to the other. The throat sections in combination with the circumferentially extending apertures enable introduction of the fuel in the plane of the throats and the minimum cross-sectional area of the plenum causing a highly uniform fuel/air mixture strength distribution about the plenum notwithstanding air flow maldistribution at the pre-mixer inlet.

More particularly, the gas fuel flow distribution matches the air flow distribution at the throat areas of the coaxial injector. Thus, if the air flow entering the plenum inlet is maldistributed, the air flow through individual throats between the fuel tubes is either increased or decreased relative to the flow of air through the other throats. Any increase in air flow velocity will result in a decrease in the static pressure at that throat and, accordingly, an increase in the pressure drop across the pre-mix gas fuel apertures of the fuel tubes. This causes an increase in gas fuel flow to the throat with the higher air flow velocity. Conversely, any decrease in air velocity due to maldistribution of air flow at the plenum inlet at any throat will result in an increase in the static pressure at that throat and a decrease in the pressure drop across the pre-mix gas fuel apertures, resulting in a decrease of fuel flow to that throat. As a consequence, a uniform fuel/air mixture strength distribution is provided at the throats and in the pre-mix chamber, notwithstanding the maldistribution of air flow entering the pre-mix plenum. Uniform fuel/air mixture strength distribution in the pre-mix cup and the combustion chamber is therefore achieved so that uniform hot gas temperature distribution in the combustor reaction zone is maintained, minimizing the formation of objectionable air polluting emissions. The fuel/air pre-mixer is therefore tolerant of inlet air flow maldistribution. The dual injector hereof is also resistant to flashback of combustion into the pre-mixing chamber and capable of flame holding downstream of the pre-mixer, as required to obtain low emissions from using a lean mixture. The resistance to combustion flashback is provided by the aerodynamic vanes in the swirler located downstream of the pre-mixing chamber. The swirler also induces a recirculating flow in the combustion chamber providing the necessary flame holding capability for lean pre-mixed combustion.

In a preferred embodiment according to the present invention, there is provided a fuel/air injector for a combustor of a gas turbine comprising a fuel/air nozzle including a plenum having a predetermined cross-sectional flow area, an inlet to the plenum for receiving air under pressure, a pre-mixing chamber downstream of the air inlet, a fuel inlet intermediate the pre-mixing chamber and the air inlet and an outlet downstream of the pre-mixing chamber, for flowing air through the air inlet and pre-mixed fuel and air through the plenum into the combustor. The fuel inlet comprises a plurality of tubes within the plenum and disposed in a plane extending substantially normal to the direction of flow through the plenum, the tubes being spaced substantially uniformly one from the other in the plane. Means are provided for supplying fuel to the tubes, the tubes having apertures for flowing fuel from the tubes into the plenum and in a direction substantially in the plane of the tubes, the space between the tubes in the plenum defining in the aggregate a minimum throat area of the plenum so that a substantially uniform fuel/air mixture strength distribution obtains substantially at the throats and in the plane for flow through the pre-mixing chamber and the outlet into the combustor.

In a further preferred embodiment according to the present invention, there is provided a fuel/air injector for a combustor of a gas turbine comprising a fuel/air nozzle including an annular plenum having an axis, an inlet to the plenum for receiving air under pressure, an outlet for flowing a fuel/air mixture into the combustor, and a fuel inlet intermediate the outlet and the air inlet. The fuel inlet comprises a plurality of fuel dispensing apertures within the plenum and disposed in a plane extending substantially normal to the axis of the plenum, the fuel dispensing apertures being spaced substantially uniformly one from the other in the plane and about the plenum. The apertures are disposed for flowing fuel into the plenum in a direction substantially in the plane, the cross-sectional area of the plenum at the plane defining a minimum cross-sectional area of the plenum so that a substantially uniform fuel/air mixture strength distribution obtains substantially at the minimum cross-sectional area of the plenum.

In a still further preferred embodiment of the present invention, there is provided a method for pre-mixing air and fuel in an injector for a gas turbine combustor, comprising the steps of flowing air through an annular plenum having a plurality of fuel injection spokes extending generally radially within the plenum and circumferentially spaced one from the other to form a plurality of throat areas therebetween which, in the aggregate, define a minimum cross-sectional area through the plenum in a plane normal to the direction of flow through the plenum and injecting fuel into each of the throat areas substantially in the direction of the plane thereof to afford a substantially uniform distribution of fuel/air mixture in the flow exiting the throat areas within the plenum.

Accordingly, it is a primary object of the present invention to provide a dual fuel injector in a combustor for combining the characteristics of a diffusion flame combustor with the low emissions capability of a lean pre-mixed combustion system to provide a combustion system which will function over the entire operating range of a heavy-duty industrial gas turbine and provide extremely low emissions of air pollutants in the gas turbine exhaust over a selected portion of the operating range. Moreover, this is to be effected in a compact envelope, with minimal risk of combustion flashback into a pre-mixing zone and the capacity to tolerate non-uniform distribution of air flow/velocity at the pre-mixer inlet without significant degradation in performance.

BEST MODE FOR CARRYING OUT THE INVENTION

Reference will now be made in detail to a present preferred embodiment of the invention, an example of which is illustrated in the accompanying drawings.

Figure 1:
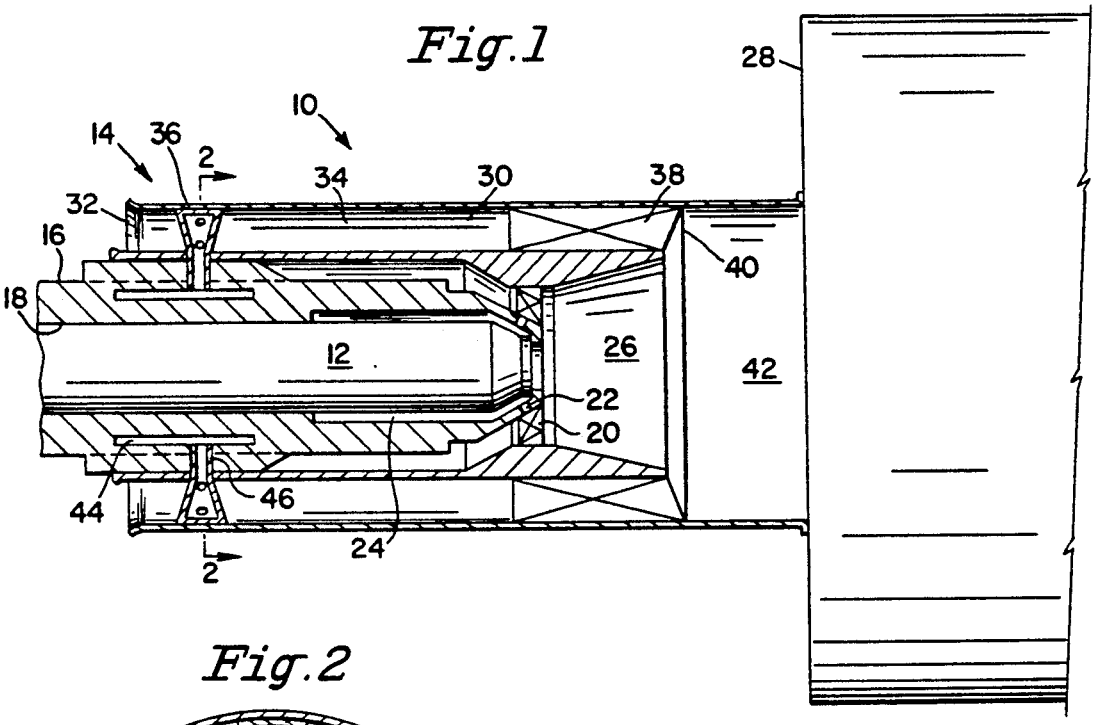
FIG. 1 is a fragmentary longitudinal cross-sectional view of a dual fuel injector with pre-mixing capability for low emissions combustion according to the present invention.

Referring now to the drawing figures, particularly to FIG. 1, there is illustrated a dual fuel injector according to the present invention, generally designated 10, comprised of a central nozzle 12 and a coaxial fuel injector, generally designated 14, for pre-mixing fuel and air for low emissions combustion. The central diffusion gas fuel nozzle 12 includes a sleeve 16 having a central bore 18 for receiving an air atomized liquid fuel. The diffusion gas nozzle sleeve 16 includes a gas tip having an air swirler 20, for example, comprised of several angled slots which impart a swirl to the incoming flow. Diffusion gas holes 22 are provided at the base of the air swirl slots and receive high pressure gas fuel supplied to a manifold 24 for injection into the diffusion air flow by way of slots 22. The combined air and diffusion gas flow exits the swirlers 20 and enters a diffusion mixing cup 26. The swirling flow induces a recirculation zone along the center line of the diffusion flame mixing cup 26, causing the hot gas to be drawn back from the reaction zone of the combustor 28 and anchors the flame front within the diffusion flame mixing cup 26. The foregoing-described high pressure air atomized liquid fuel nozzle is conventional in design. To afford a lean pre-mixed operation, with minimization or elimination of objectionable air polluting emissions in the gas turbine exhaust, there is provided an additional coaxial injector 14.

Figure 2:
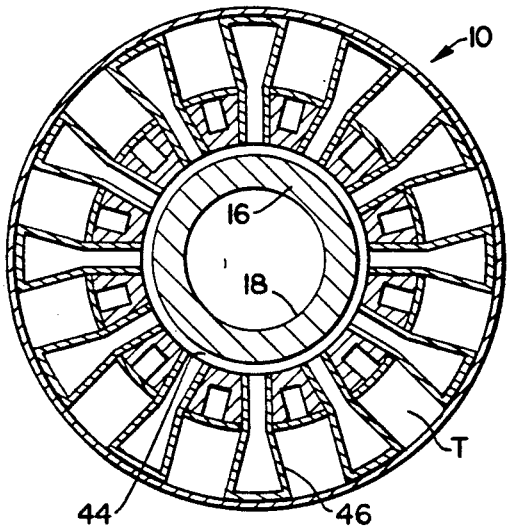
FIG. 2 is a cross-sectional view thereof taken generally about on line 2—2 in FIG. 1.
Figure 3:
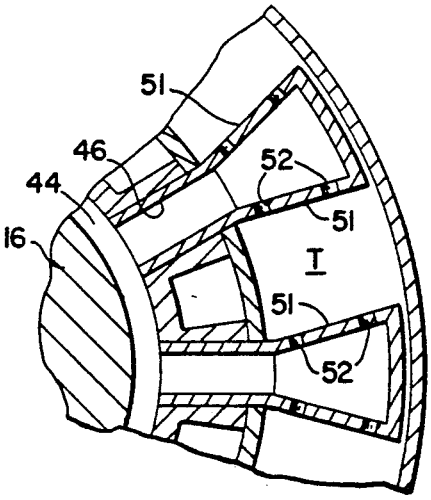
FIG. 3 is an enlarged fragmentary cross-sectional view illustrating the fuel spokes or tubes in the annular plenum.

Injector 14 includes a plenum 30, preferably annular, having an air inlet 32 for receiving compressor air, a pre-mix chamber 34, a fuel inlet region 36 between air inlet 32 and pre-mix chamber 34, and a pre-mix swirler assembly 38 at the outlet 40 of the injector. Thus, compressor air flows through air inlet 32 for mixing with fuel in the region 36 whereby the fuel/air mixture flows through pre-mix chamber 30, past swirlers 38 and through the outlet 40 into a pre-mix cup 42. Fuel is supplied to the pre-mix region 36 from a manifold 44 which supplies fuel to a plurality of radially projecting, circumferentially spaced spokes or tubes 46. Tubes 46 extend from the manifold 44 radially outwardly into and across the annular plenum 30 and in a plane normal to the axis of the plenum. As best illustrated in FIGS. 2 and 3, the spokes or tubes 46 define throat areas T between adjacent tubes. Importantly, the aggregate of the cross-sectional area of the throat areas T forms the minimum cross-sectional area for the flow through the plenum 30, the aggregate of the cross-sectional areas through the swirler blades 38 being larger than the aggregate of the cross-sectional areas of the throats in the fuel supply region 36 of the plenum. While the tubes or spokes 46 may be of different cross-sectional configuration, they are preferably circular. As best illustrated in FIG. 3, the spokes or tubes 46 include outwardly diverging circular portions or frustoconical sections 50 which increase in cross-sectional area in a radially outward direction. The opposed walls 51 of the tubes 46 within the plenum essentially form the throat areas T.

Figure 4:
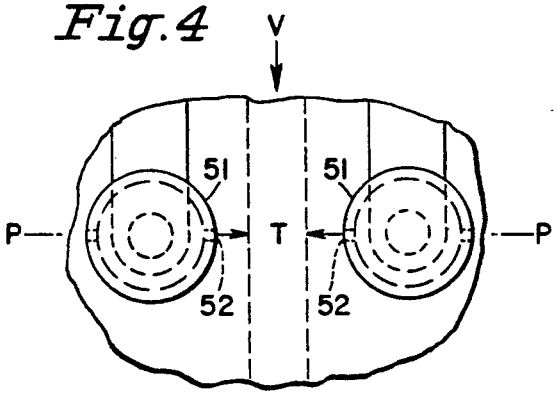
FIG. 4 is an enlarged fragmentary elevational view looking radially inwardly of a pair of the fuel spokes.

Each of the spokes or tubes 46 includes one or more apertures 52, two being illustrated, which open from each side of the spokes or tubes, i.e., through opposed walls 51, in a circumferential direction in the plane of the throats T. That is, a plane passing through the throats T and extending substantially normal to the direction of flow through and the axis of plenum 30 intersects the apertures 52. It will also be appreciated from a review of FIG. 3 that apertures 52 of adjacent tubes within the annular plenum lie in circumferential opposition one to the other whereby circumferentially opposed fuel flows obtain from the opposed apertures 52. Consequently, as illustrated in FIG. 4, the flow direction is designated V and the plane containing the throats and passing through the apertures 52 is designated P—P. Thus, the direction of the flows of fuel from the spokes or tubes 46 into each throat area T between the fuel spokes or tubes extends in the plane P—P, circumferentially about the plenum, and normal to the direction of flow through and the axis of the annular plenum. It will therefore be appreciated that the fuel is injected in the plane containing the throat areas and at the minimum cross-sectional area of flow through plenum 30.

In operation, the central nozzle operates in a conventional fashion and a description thereof is not believed necessary. With respect to the coaxial injector 14, air is supplied at inlet 32 from the compressor and conventionally would be of non-uniform distribution about the annulus of the plenum inlet 32. Fuel is supplied to the spokes or tubes 46 from the manifold 44 and flows radially outwardly and then circumferentially into the throat areas T between adjacent fuel spokes or tubes in the circumferential plane of minimum cross-sectional area of the plenum and normal to the direction of flow. The fuel mixes with the incoming air in the throat areas, is thoroughly mixed in the pre-mix chamber 34, and flows through the pre-mix swirler 38 where the aerodynamic turning vanes of the swirler accelerates the flow to a high velocity which prevents flashback of combustion from the reaction zone into the pre-mix chamber 34. The rotation imparted by the pre-mix flow by the pre-mix swirler causes, in conjunction with the central nozzle, a central recirculation flow of hot gases from the combustion chamber into the pre-mix cup 42, resulting in stabilization of the pre-mix flame front within cup 42.

The geometry of the fuel spokes and tubes defining the throat areas and the fuel apertures 52 produces a uniform fuel/air mixture distribution at the plane P—P, notwithstanding non-uniform air flow patterns entering the plenum or extant in the pre-mix chamber 34. By forming the minimum cross-sectional area of the plenum at the throats T and introducing fuel in a circumferential direction normal to the flow through the plenum, the air and fuel flows automatically adjust to provide a uniform mixture distribution at the plane of the fuel injection. For example, if the air flow at an individual throat T is increased relative to the other throats, the increase in air velocity results in a decrease in static pressure. The reduction in static pressure at the throat results in an increase in pressure drop across the pre-mix gas fuel apertures. This, in turn, results in an increase in fuel flow to that throat T with the higher velocity air flow. Conversely, if the air flow to an individual throat is decreased relative to the other throats, the decrease in air velocity results in an increase in static pressure at that throat. This increase in static pressure at that throat results in a decrease in the pressure drop across the pre-mix fuel apertures, resulting in a decrease in fuel flow to that throat. The net effect of this phenomena is to maintain a uniform fuel/air mixture strength distribution at the throat areas and exiting the pre-mix chamber 34. By affording uniform fuel/air mixture strength distribution in the pre-mix cup, uniform hot gas temperature distribution in the combustor reaction zone is maintained, thereby minimizing the formation of objectionable air polluting emissions.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel/air injector for a combustor of a gas turbine comprising:

a fuel/air nozzle including a plenum having a predetermined cross-sectional flow area, an inlet to said plenum for receiving air under pressure, a pre-mixing chamber downstream of said air inlet, a fuel inlet intermediate said pre-mixing chamber and said inlet and an outlet downstream of said pre-mixing chamber, for flowing air through said air inlet and pre-mixed fuel and air through said plenum and said outlet into the combustor;

said fuel inlet comprising a plurality of tubes within said plenum and disposed in a plane extending substantially normal to the direction of flow through sad plenum, said tubes being spaced substantially uniformly one from the other in said plane to define a plurality of throat areas between the tubes in said plenum;

means for supplying fuel to said tubes;

said tubes being apertures for flowing fuel from said tubes into said throat areas of said plenum and in a direction substantially in the plane of said tubes, the throat areas defined between said tubes in said plenum defining in the aggregate a minimum throat area of said plenum so that a substantially uniform fuel/air mixture strength distribution obtains substantially at said throat areas and in said plane for flow through said pre-mixing chamber and said outlet into the combustor.

2. An injector according to claim 1 wherein said plenum is annular and has an axis, said tubes extending substantially radially into said plenum, said plane extending substantially radially of and normal to the axis of said annular plenum.

3. An injector according to claim 2 including a central fuel/air nozzle within said annular plenum and having an outlet for supplying a fuel/air mixture to the combustor, and a pre-mix cup downstream of said outlets for receiving the fuel/air mixtures therefrom.

4. An injector according to claim 2 wherein said fuel supply means includes a manifold for supplying fuel to each of said tubes.

5. An injector according to claim 2 wherein each of said tubes has at least a pair of apertures opening therethrough for flowing fuel in generally opposite circumferential directions, respectively, in said plane and toward adjacent radially extending tubes.

6. An injector according to claim 5 wherein said apertures lie in circumferential registry with apertures of the adjacent tubes so that fuel flow through the apertures of adjacent tubes are opposed to one another and directed into said throat area therebetween.

7. An injector according to claim 5 wherein each tube has a pair of apertures opening circumferentially through each of its opposite sides substantially in said plane for flowing fuel therethrough, each said pair of apertures lying in circumferential registry with a pair of apertures of a next adjacent tube so that fuel flows through said registering apertures of adjacent tubes, respectively, are opposed to one another and directed into said throat area therebetween.

8. An injector according to claim 7 including a central fuel/air nozzle within said annular plenum and having an outlet for supplying a fuel/air mixture to the combustor, and a pre-mi cup downstream of said outlets for receiving the fuel/air mixtures therefrom.

9. An injector according to claim 8 including a swirler assembly at said outlet from said plenum for accelerating the flow and imparting rotation thereto.

10. An injector according to claim 1 wherein said plenum is annular and has an axis, said tubes extending substantially radially into said plenum, said plane extending substantially radially of and normal to the axis of said annular plenum, a central fuel/air nozzle within said annular plenum and having an outlet for supplying a fuel/air mixture to the combustor, and a pre-mix cup downstream of said outlets for receiving the fuel/air mixtures therefrom, each of said tubes having at least a pair of apertures opening therethrough for flowing fuel in generally opposite circumferential directions, respectively, in said plane and toward adjacent radially extending tubes, said apertures lying in circumferential registry with apertures of the adjacent tubes so that fuel flow through the apertures of adjacent tubes are opposed to one another and directed into said throat area therebetween, said tubes being substantially uniformly circumferentially spaced about said plenum and exceeding eight in number.

11. An injector according to claim 10 wherein the tubes extend between opposed walls of said annular plenum, the tubes having radially outwardly diverging opposed walls forming said throat areas with adjacent tubes in said plenum.

12. A fuel/air injector for a combustor of a gas turbine comprising:

a fuel/air nozzle including an annular plenum having an axis, an inlet to said plenum for receiving air under pressure, an outlet for flowing a fuel/air mixture into the combustor, and a fuel inlet intermediate said outlet and said air inlet;

said fuel inlet comprising a plurality of fuel dispensing elements within said plenum having apertures, said elements and said apertures being disposed in a plane extending substantially normal to the axis of said plenum, said fuel dispensing elements being spaced substantially uniformly one from the other in said plane and about said plenum to define a plurality of throat areas between said elements in said plenum;

said apertures being disposed for flowing fuel into said plenum and into said throat areas in a direction substantially in said plane, the throat areas defined between said elements defining a minimum cross-sectional area of said plenum at said plane so that a substantially uniform fuel/air mixture strength distribution obtains substantially at said minimum cross-sectional area of said plenum.

13. An injector according to claim 12 including a central fuel/air nozzle within said annular plenum and having an outlet for supplying a fuel/air mixture to the combustor, and a pre-mix cup downstream of said outlets for receiving the fuel/air mixtures therefrom.

14. An injector according to claim 12 wherein said apertures are spaced circumferentially one from the other and are directed so that fuel flows through circumferentially adjacent apertures are opposed to one another and directed into said plane of minimum cross-sectional area.

15. An injector according to claim 11 including a swirler assembly at said outlet from said plenum for accelerating the flow and imparting rotation thereto.

16. A method for pre-mixing air and fuel in an injector for a gas turbine combustor, comprising the steps of:

flowing air through an annular plenum having a plurality of fuel injection elements extending generally radially within said plenum and circumferentially spaced one from the other define a plurality of throat areas between the elements in said plenum and which throat areas, in the aggregate, define a minimum cross-sectional area through the plenum in a plane normal to the direction of flow through the plenum; and injecting fuel from said elements into each of said throat areas substantially in the direction of said plane thereof to provide a substantially uniform distribution of fuel/air mixture in the flow exiting the throat areas within the plenum.

17. A method according to claim 16 including locating fuel apertures in circumferentially adjacent elements in circumferential opposition one to the other so that fuel flows through the apertures of adjacent elements lie in circumferential opposition one to the other.

18. A method according to claim 16 including locating a pair of fuel apertures in each element on each side thereof in registration with a pair of fuel apertures in a circumferentially adjacent element so that fuel may be injected into said throat areas at radially spaced locations therealong and in fuel flows in opposition to one another.

19. A method according to claim 16 including injecting fuel from adjacent fuel elements into the throat area therebetween from circumferentially opposite sides of said fuel elements such that the direction fuel injection is in circumferential opposition to one another.

* * * * *